US011009283B2

(12) United States Patent
Li

(10) Patent No.: US 11,009,283 B2
(45) Date of Patent: May 18, 2021

(54) SYSTEM AND METHOD FOR DEFROSTING/DE-ICING AN AIR-CONDITIONER

(71) Applicant: Wu Qi Technologies, Inc., Chongqing (CN)

(72) Inventor: Hongbing Li, Chongqing (CN)

(73) Assignee: WU QI TECHNOLOGIES, INC., Chongqing (CN)

( * ) Notice: Subject to any disclaimer, the term of this patent is extended or adjusted under 35 U.S.C. 154(b) by 0 days.

(21) Appl. No.: 16/327,901

(22) PCT Filed: Apr. 16, 2018

(86) PCT No.: PCT/CN2018/083179
§ 371 (c)(1),
(2) Date: Feb. 25, 2019

(87) PCT Pub. No.: WO2019/074095
PCT Pub. Date: Sep. 19, 2019

(65) Prior Publication Data

US 2020/0408458 A1 Dec. 31, 2020

(30) Foreign Application Priority Data

Mar. 15, 2018 (CN) ..... 201810215171.4

(51) Int. Cl.
*F25D 21/00* (2006.01)
*F25B 47/02* (2006.01)

(52) U.S. Cl.
CPC ..... *F25D 21/006* (2013.01); *F25B 47/02* (2013.01); *F25B 2700/11* (2013.01); *F25B 2700/111* (2013.01)

(58) Field of Classification Search
CPC ..... F25B 2700/11; F25D 21/006
See application file for complete search history.

(56) References Cited

U.S. PATENT DOCUMENTS

2012/0198864 A1* 8/2012 Rosenlund ..... F25D 21/02 62/80
2013/0031921 A1* 2/2013 Hamada ..... F25D 21/08 62/155

(Continued)

FOREIGN PATENT DOCUMENTS

CN 102878663 A 1/2013
CN 105222285 A 1/2016

(Continued)

OTHER PUBLICATIONS

Written Opinion received for PCT Patent Application No. PCT/CN2018/083179 dated Nov. 29, 2018, 10 pages.

*Primary Examiner* — Nelson J Nieves
(74) *Attorney, Agent, or Firm* — Amster, Rothstein & Ebenstein LLP

(57) ABSTRACT

A system and a method for defrosting/de-icing an air-conditioner are provided, the system comprising: a 3D depth sensor disposed inside an air-conditioner outdoor unit casing, for acquiring information regarding outer diameters of pipes of an outdoor heat exchanger, distances between the pipes, and distances between the respective pipes and an air-conditioner outdoor unit casing side plate; and a controller connected to the 3D depth sensor, for receiving the information acquired by the 3D depth sensor and controlling the air conditioner to enter or exit a defrosting-deicing mode. The system and method for defrosting/de-icing an air-conditioner provided by the present disclosure can effectively and timely perform defrost/de-ice operation on the outdoor heat exchanger to prevent freezing; besides, it can prevent the impact on the air-conditioner's heating function to the utmost extent so as to significantly improve user experience.

4 Claims, 3 Drawing Sheets

(56) References Cited

U.S. PATENT DOCUMENTS

| | | | | |
|---|---|---|---|---|
| 2013/0042638 | A1* | 2/2013 | Eom | F25D 21/006 62/80 |
| 2015/0247663 | A1* | 9/2015 | Park | F25D 21/006 62/157 |
| 2016/0238301 | A1 | 8/2016 | Denton | |
| 2020/0181239 | A1* | 6/2020 | Platt | C07K 14/8139 |

FOREIGN PATENT DOCUMENTS

| | | | | | |
|---|---|---|---|---|---|
| CN | 107796083 | A | | 3/2018 | |
| EP | 3339774 | A1 | * | 6/2018 | F25D 21/02 |
| JP | 2014-169802 | A | | 9/2014 | |
| KR | 20180024323 | A | * | 3/2018 | F25D 21/02 |

* cited by examiner

SYSTEM AND METHOD FOR DEFROSTING/DE-ICING AN AIR-CONDITIONER

CROSS-REFERENCE TO RELATED APPLICATIONS

This application is a National Stage entry under 35 U.S.C. 371 of International Patent Application No. PCT/CN2018/083179, filed on Apr. 16, 2018, which claims priority from Chinese Patent Application No. CN 201810215171.4, filed Mar. 15, 2018, the entire contents of each of which are incorporated by reference herein.

FIELD

Embodiments of the present disclosure relate to the technical field of air-conditioning equipment, and more particularly relate to a system and a method for defrosting/de-icing an air-conditioner.

BACKGROUND

Current air-conditioners available in the market generally have an automatic defrost function when operating to heat in winter. The automatic defrost function is typically differentiated into two types: time-controlled and temperature-controlled.

When an outdoor temperature is relatively low (around 0° C.) and an air humidity is relatively high, the high water content in the air is easily condensed and attached onto a heat sink, causing an outdoor heat exchanger to get icy. An incomplete defrost would gradually cause buildup of frost and then cause an icy status.

The time-controlled defrost generally lasts 15 to 30 minutes. As an air-conditioner controls an operating program by time, even the frost fails to be completely removed within 15 to 30 minutes, it still switches to heating. So, with elapse of time, frost on the outdoor unit will build up and then get icy. In the case of temperature-controlled defrosting, the air-conditioner mainly works to de-ice if the temperature and the power are relatively low, which seriously affects the heating function.

The deficiencies in the existing technologies for defrosting/de-icing air-conditioner cause a poor user experience.

SUMMARY

An object of the present disclosure is to provide a system and a method for defrosting/de-icing an air-conditioner so as to solve the problems in the prior art.

To achieve the object above, the present disclosure provides a system for defrosting/de-icing an air-conditioner, comprising:

a 3D depth sensor disposed inside an air-conditioner outdoor unit casing, for acquiring information regarding outer diameters of pipes of an outdoor heat exchanger, distances between the pipes, and distances between the respective pipes and an air-conditioner outdoor unit casing side plate;

a controller connected to the 3D depth sensor, for receiving the information acquired by the 3D depth sensor and controlling the air-conditioner to enter or exit a defrost/de-ice mode; wherein when the outer diameters of the pipes of the outdoor heat exchanger, the distances between the pipes, and the distances between the respective pipes and the air-conditioner outdoor unit casing side plate are all greater than their respective set thresholds, the controller controls the air-conditioner to enter the defrost/de-ice mode; and when the outer diameters of the pipes of the outdoor heat exchanger, the distances between the pipes, and the distances between the respective pipes and the air-conditioner outdoor unit casing side plate are all lower than or equal to their respective set thresholds, the controller controls the air-conditioner to exit the defrost/de-ice mode.

In the system for defrosting/de-icing an air-conditioner, the 3D depth sensor comprises:

a first acquiring module configured for acquiring information regarding the outer diameters of the pipes of the outdoor heat exchanger;

a second acquiring module configured for acquiring information regarding the distances between the pipes of the outdoor heat exchanger;

a third acquiring module configured for acquiring information regarding the distances between the respective pipes of the outdoor heat exchanger and the air-conditioner outdoor unit casing side plate; and a transmitting module configured for transmitting the acquired information to a controller, the transmitting module being connected to the first acquiring module, the second acquiring module, the third acquiring module, and the controller, respectively.

In the system for defrosting/de-icing an air-conditioner, the controller comprises:

a receiving module configured for receiving the information acquired by the 3D depth sensor, the receiving module being connected to the 3D depth sensor;

a determining module configured for determining whether the received information is greater than their respective set thresholds, the determining module being connected to the receiving module, and a command module configured for controlling the air-conditioner to enter or exit the defrost/de-ice mode, the command module being connected to the determining module.

In the system for defrosting/de-icing an air-conditioner, the determining module comprises:

a first determining module configured for determining whether the outer diameters of the pipes of the outdoor heat exchanger are greater than a first set threshold;

a second determining module configured for determining whether the distances between the pipes of the outdoor heat exchanger are greater than a second set threshold; and a third determining module configured for determining whether the distances between the respective pipes of the outdoor heat exchanger and the air-conditioner outdoor unit casing side plate are greater than a third set threshold; and the first determining module, the second determining module, and the third determining module are connected to the receiving module and the command module, respectively.

The present disclosure further provides a method for defrosting/de-icing an air-conditioner, comprising:

acquiring information regarding outer diameters of pipes of an outdoor heat exchanger, distances between the pipes, and distances between the respective pipes and an air-conditioner outdoor unit casing side plate;

when the outer diameters of the pipes of the outdoor heat exchanger, the distances between the pipes, and the distances between the respective pipes and an air-conditioner outdoor unit casing side plate are all greater than their respective set thresholds, controlling, by a controller, the air-conditioner to enter a defrost/de-ice mode;

and when the outer diameters of the pipes of the outdoor heat exchanger, the distances between the pipes, and the distances between the respective pipes and the air-conditioner outdoor unit casing side plate are all lower than or equal to their respective set thresholds, controlling, by the controller, the air-conditioner to exit the defrost/de-ice mode.

The present disclosure further provides a computer device, comprising a memory, a processor, and a computer program stored on the memory and executable on the processor, wherein the computer program, when being executed by the processor, implements the above method for defrosting/de-icing an air-conditioner.

The present disclosure further provides a computer readable storage medium on which a computer program is stored, wherein the program, when being executed by the processor, implements the above method for defrosting/de-icing an air-conditioner.

Compared with the prior art, the present disclosure has the following beneficial effects:

The system and method for defrosting/de-icing an air-conditioner provided by the present disclosure can effectively and timely perform defrosting/de-icing operations on the outdoor heat exchanger to prevent freezing; besides, it can prevent the impact on the air-conditioner's heating function to the utmost extent so as to significantly improve user experience. Besides, the present disclosure is simple and easy to operate with a lower cost, such that it is eligible for large-scale applications.

DETAILED DESCRIPTION OF EMBODIMENTS

Hereinafter, the present disclosure will be further described with reference to the preferred embodiments in conjunction with the accompanying drawings. These embodiments are only used for illustrating the present disclosure, not for limiting the protection scope of the present disclosure.

Figure 1:
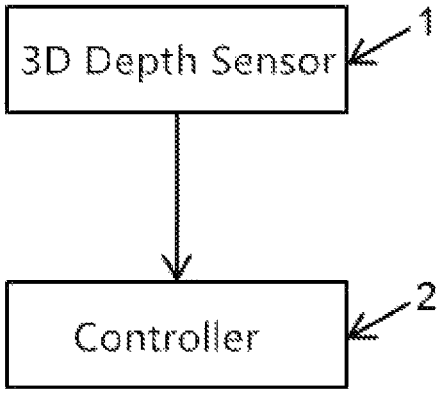
FIG. 1 is a structural schematic diagram of an embodiment of a system for defrosting/de-icing an air-conditioner according to the present disclosure.
Figure 2:
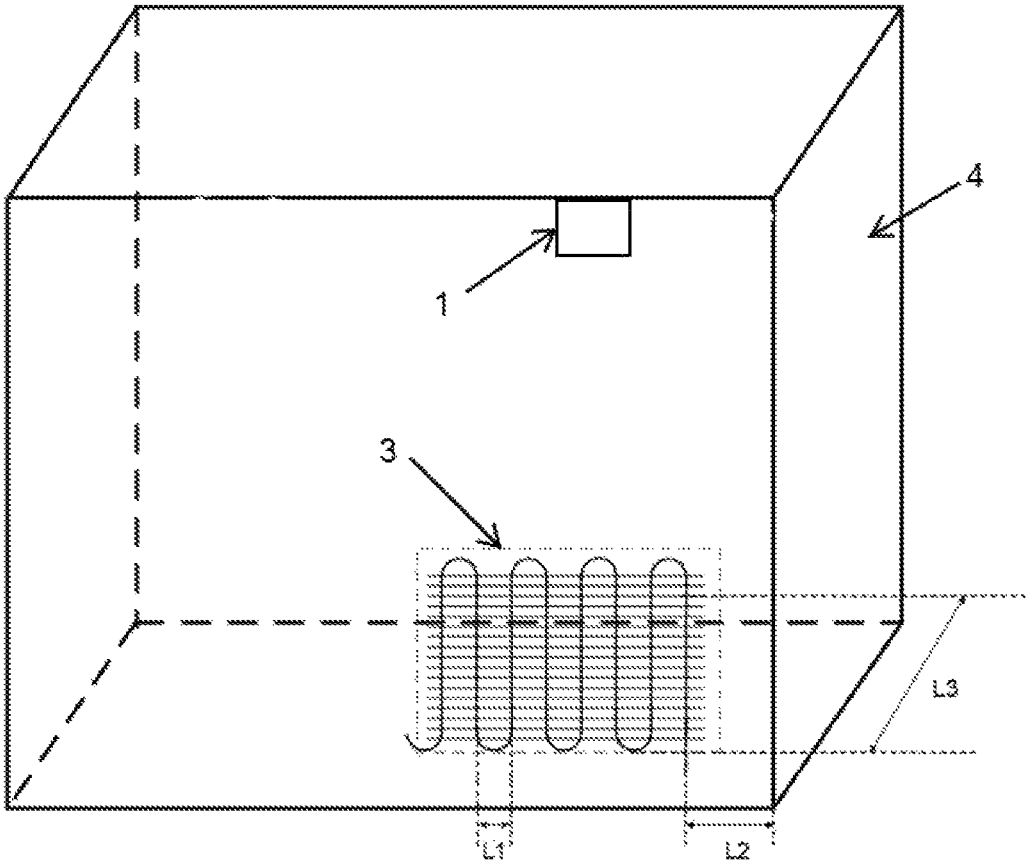
FIG. 2 is a schematic diagram of acquiring information by a 3D depth sensor according to the present disclosure.

As shown in FIGS. 1 and 2, the present disclosure provides a system for defrosting/de-icing an air-conditioner, comprising:

a 3D depth sensor 1 disposed inside an air-conditioner outdoor unit casing 4, for acquiring information regarding outer diameters of pipes of an outdoor heat exchanger 3, distances (L1) between the pipes, and distances (L2, L3) between the respective pipes and an air-conditioner outdoor unit casing 4 side plate;

a controller 2 connected to the 3D depth sensor 1, for receiving the information acquired by the 3D depth sensor 1 and controlling the air-conditioner to enter or exit a defrost/de-ice mode;

when the outer diameters of the pipes of the outdoor heat exchanger 3, the distances between the pipes, and the distance between the respective pipes and the air-conditioner outdoor unit casing 4 side plate are all greater than their respective set thresholds, the controller 2 controls the air-conditioner to enter the defrost/de-ice mode; and when the outer diameters of the pipes of the outdoor heat exchanger 3, the distances between the pipes, and the distances between the respective pipes and the air-conditioner outdoor unit casing 4 side plate are all lower than or equal to their respective set thresholds, the controller 2 controls the air-conditioner to exit the defrost/de-ice mode.

In the technical solution, the 3D depth sensor 1 can be any sensor having a three-dimensional imaging function.

Figure 3:
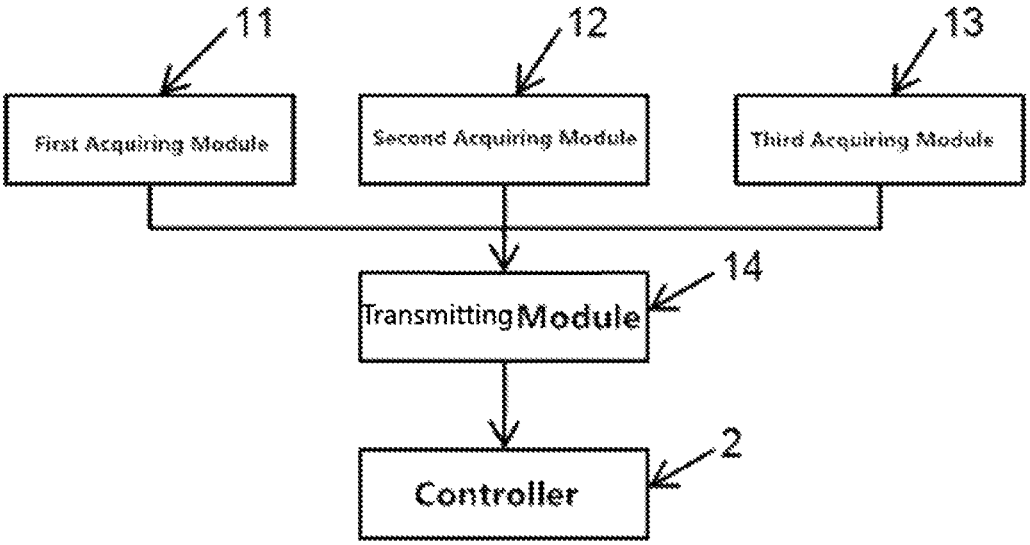
FIG. 3 is a structural schematic diagram of another embodiment of a system for defrosting/de-icing an air-conditioner according to the present disclosure.

As shown in FIG. 3, in a preferred embodiment, the 3D depth sensor 1 comprises:

a first acquiring module 11 configured for acquiring information regarding the outer diameters of the pipes of the outdoor heat exchanger 3;

a second acquiring module 12 configured for acquiring information regarding the distances between the pipes of the outdoor heat exchanger 3;

a third acquiring module 13 configured for acquiring information regarding the distances between the respective pipes of the outdoor heat exchanger 3 and the air-conditioner outdoor unit casing 4 side plate; and a transmitting module 14 configured for transmitting the acquired information to a controller 2, the transmitting module being connected to the first acquiring module 11, the second acquiring module 12, the third acquiring module 13, and the controller 2, respectively.

Figure 4:
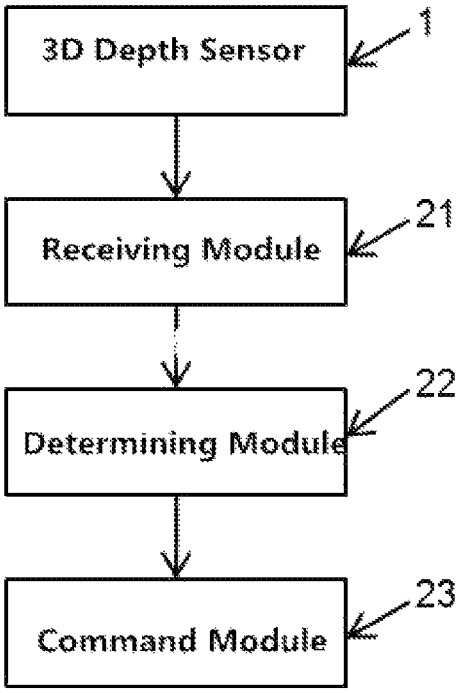
FIG. 4 is a structural schematic diagram of a further embodiment of a system for defrosting/de-icing an air-conditioner according to the present disclosure.

As shown in FIG. 4, in a preferred embodiment, the controller 2 comprises:

a receiving module 21 configured for receiving the information acquired by the 3D depth sensor 1, the receiving module being connected to the 3D depth sensor 1;

a determining module 22 configured for determining whether the received information is greater than their respective set thresholds, the determining module being connected to the receiving module 21, and a command module 23 configured for controlling the air-conditioner to enter or exit the defrost/de-ice mode, the command module being connected to the determining module 22.

Figure 5:
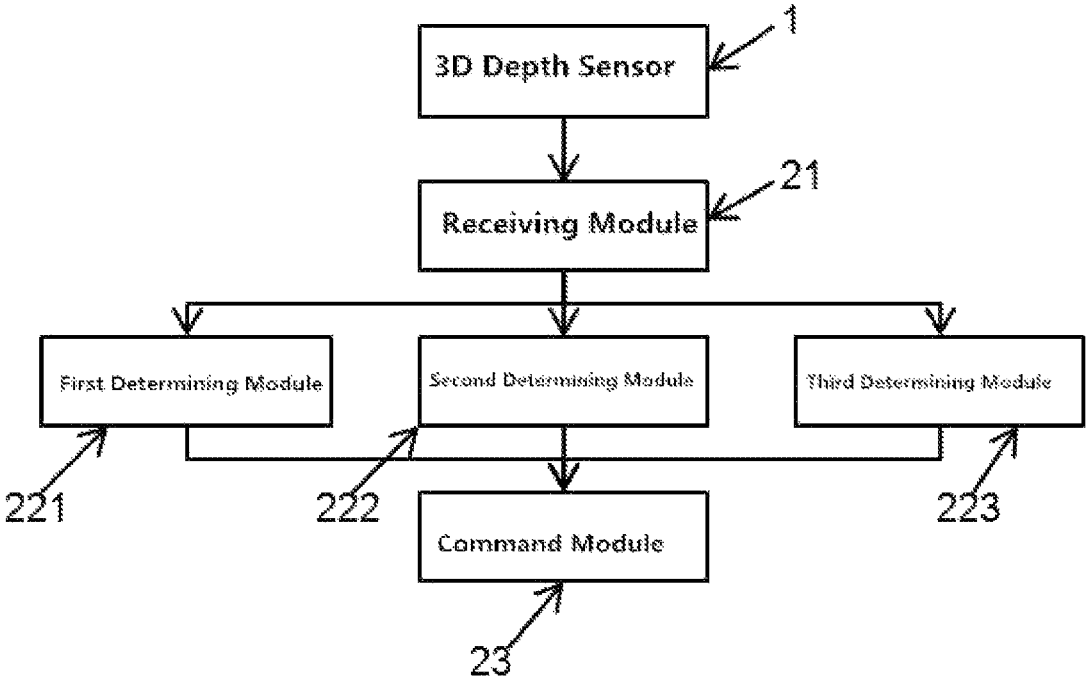
FIG. 5 is a structural schematic diagram of a still further embodiment of a system for defrosting/de-icing an air-conditioner according to the present disclosure.

As shown in FIG. 5, in a preferred embodiment, the determining module 22 comprises:

a first determining module 221 configured for determining whether the outer diameters of the pipes of the outdoor heat exchanger 3 are greater than a first set threshold;

a second determining module 222 configured for determining whether the distances between the pipes of the outdoor heat exchanger 3 are greater than a second set threshold; and a third determining module 223 configured for determining whether the distances between the respective pipes of the outdoor heat exchanger 3 and the air-conditioner outdoor unit casing 4 side plate are greater than a third set threshold; and the first determining module 221, the second determining module 222, and the third determining module 223 are connected to the receiving module 21 and the command module 23, respectively.

The present disclosure further provides a method for defrosting/de-icing an air-conditioner, comprising:

acquiring information regarding outer diameters of pipes of an outdoor heat exchanger 3, distances between the pipes, and distances between the respective pipes and an air-conditioner outdoor unit casing 4 side plate;

when the outer diameters of the pipes of the outdoor heat exchanger 3, the distances between the pipes, and the distances between the respective pipes and the air-conditioner outdoor unit casing 4 side plate are all greater than their respective set thresholds, controlling, by a controller, the air-conditioner to enter a defrost/de-ice mode;

and when the outer diameters of the pipes of the outdoor heat exchanger 3, the distances between the pipes, and the distances between the respective pipes and the air-conditioner outdoor unit casing 4 side plate are all lower than or equal to their respective set thresholds, controlling, by the controller, the air-conditioner to exit the defrost/de-ice mode.

In a preferred embodiment, the present disclosure further provides a computer device, comprising a memory, a processor, and a computer program stored on the memory and executable on the processor, wherein the computer program, when being executed by the processor, implements the above method for defrosting/de-icing an air-conditioner. In the technical solution, the computer program for executing the method for defrosting/de-icing an air-conditioner is stored on the memory; when the processor executes the computer program, a freezing/frosting status of the air-conditioner outdoor heat exchanger 3 may be accurately determined, de-icing/defrosting may be implemented, energy consumption of the air-conditioner may be reduced, and heating performance of the air-conditioner may be improved.

In a preferred embodiment, the present disclosure further provides a computer readable storage medium on which a computer program is stored, wherein the program, when being executed by a processor, implements the above method for defrosting/de-icing an air-conditioner. In the technical solution, to implement the method for defrosting/de-icing an air-conditioner, the processor needs to rely on the computer program, and the computer program needs to be stored in the computer-readable medium. The computer-readable medium guarantees that the computer program may be executed by the processor, so as to accurately determine the freezing/frosting status of the air-conditioner outdoor heat exchanger, timely de-ice and defrost, reduce energy consumption of the air-conditioner, and improve the heating performance of the air-conditioner.

In view of the above, the system and method for defrosting/de-icing an air-conditioner provided by the present disclosure may determine, through a controller in real time, the information regarding the freezing/frosting status of the outdoor heat exchanger by means of a 3D depth sensor based on a three-dimensional imaging depth measurement technology according to a principle that the outer diameters of the pipes of the outdoor heat exchanger, the distances between the pipes, or the distances between the respective pipes and the air-conditioner outdoor unit casing side plate vary after freezing/frosting, and then may effectively and timely perform defrosting/de-icing operations on the outdoor heat exchanger to prevent freezing; besides, it may prevent the impact on the air-conditioner's heating function to the utmost extent so as to significantly improve user experience. Besides, the present disclosure is simple and easy to operate with a low cost, such that it is eligible for large-scale application.

Although the contents of the present disclosure have been described in detail through the foregoing preferred embodiments, it should be understood that the depictions above shall not be regarded as limitations to the present disclosure. After those skilled in the art having read the contents above, many modifications and substitutions to the present disclosure are all obvious. Therefore, the protection scope of the present disclosure should be limited by the appended claims.

I claim:

1. A system for defrosting/de-icing an air-conditioner, comprising:

a 3D depth sensor disposed inside an air-conditioner outdoor unit casing, for acquiring information regarding outer diameters of pipes of an outdoor heat exchanger, distances between the pipes, and distances between each of the pipes and an air-conditioner outdoor unit casing side plate;

a controller connected to the 3D depth sensor, for receiving the information acquired by the 3D depth sensor and controlling the air-conditioner to enter or exit a defrost/de-ice mode;

wherein when the outer diameters of the pipes of the outdoor heat exchanger, the distances between the pipes, and the distances between each of the pipes and the air-conditioner outdoor unit casing side plate are all greater than their respective set thresholds, the controller controls the air-conditioner to enter the defrost/de-ice mode; and when the outer diameters of the pipes of the outdoor heat exchanger, the distances between the pipes, and the distances between each of the pipes and the air-conditioner outdoor unit casing side plate are all lower than or equal to their respective set thresholds, the controller controls the air-conditioner to exit the defrost/de-ice mode.

2. A method for defrosting/de-icing an air-conditioner, comprising:

acquiring information regarding outer diameters of pipes of an outdoor heat exchanger, distances between the pipes, and distances between each of the pipes and an air-conditioner outdoor unit casing side plate;

when the outer diameters of the pipes of the outdoor heat exchanger, the distances between the pipes, and the distances between each of the pipes and the air-conditioner outdoor unit casing side plate are all greater than their respective set thresholds, controlling, by a controller, the air-conditioner to enter a defrost/de-ice mode;

and when the outer diameters of the pipes of the outdoor heat exchanger, the distances between the pipes, and the distances between each of the pipes and the air-conditioner outdoor unit casing side plate are all lower than or equal to their respective set thresholds, controlling, by the controller, the air-conditioner to exit the defrost/de-ice mode.

3. A non-transitory computer device, comprising a memory, a processor, and a computer program stored on the memory and executable on the processor, wherein the computer program, when being executed by the processor, implements the method for defrosting/de-icing an air-conditioner according to claim 2.

4. A non-transitory computer readable storage medium on which a computer program is stored, wherein the program, when being executed by a processor, implements the method for defrosting/de-icing an air-conditioner according to claim 2.

* * * * *